US008783145B2

(12) United States Patent
Deng et al.

(10) Patent No.: US 8,783,145 B2
(45) Date of Patent: Jul. 22, 2014

(54) APPARATUS FOR STRIPPING METAL SHEETS FROM CATHODE BLANK

(75) Inventors: Aimin Deng, Jiangxi (CN); Hui Ding, Jiangxi (CN); Jun Lu, Jiangxi (CN); Jianrong Xie, Jiangxi (CN)

(73) Assignee: Jiangxi Nerin Equipment Co., Ltd., Nanchang, Jiangxi (CN)

( * ) Notice: Subject to any disclaimer, the term of this patent is extended or adjusted under 35 U.S.C. 154(b) by 138 days.

(21) Appl. No.: 13/518,023

(22) PCT Filed: Dec. 23, 2010

(86) PCT No.: PCT/CN2010/080200

§ 371 (c)(1), (2), (4) Date: Jun. 21, 2012

(87) PCT Pub. No.: WO2011/076137

PCT Pub. Date: Jun. 30, 2011

(65) Prior Publication Data

US 2012/0255409 A1 Oct. 11, 2012

(30) Foreign Application Priority Data

Dec. 23, 2009 (CN) ..... 2009 1 0215961

(51) Int. Cl.

| | |
|---|---|
| ***C25C 7/08*** | (2006.01) |
| ***C25B 9/00*** | (2006.01) |
| ***C25D 1/00*** | (2006.01) |

(52) U.S. Cl.

USPC ..... 83/152; 83/153; 204/279; 204/281

(58) Field of Classification Search

USPC ..... 83/152, 154; 29/426.5, 603.02, 402.03, 29/402.2, 426.1, 426.2; 156/759, 715, 156/716; 205/76, 67, 77, 137; 204/279, 204/281, 198, 255, 227; 225/98

See application file for complete search history.

(56) References Cited

U.S. PATENT DOCUMENTS 3,625,806 A * 12/1971 Wennberg ..... 266/249
3,883,403 A * 5/1975 Ettel et al. ..... 205/76

(Continued)

FOREIGN PATENT DOCUMENTS

AU 2007203088 A1 4/2008
CN 1894441 A 1/2007

(Continued)

OTHER PUBLICATIONS

International Search Report dated Jan. 27, 2011 for corresponding International Application No. PCT/CN2010/080200, filed Dec. 23, 2010.

*Primary Examiner* — Ghassem Alie

(74) *Attorney, Agent, or Firm* — David D. Brush; Westman, Champlin & Koehler, P.A.

(57) ABSTRACT

An apparatus for stripping metal sheets from a cathode blank includes: a frame; a stripping assembly disposed on the frame; and a receiving mechanism including at least one receiving platform which is disposed on the frame for receiving the deposited metal sheets. The stripping assembly includes: first and second clipping mechanisms for clipping a conductive member on an upper end of the cathode blank; first and second stripping mechanisms for stripping the deposited metal sheets from two surfaces of the cathode blank; a bottom positioning mechanism for positioning a lower end of the cathode blank; and first and second loosening mechanisms each including a push rod which is movably disposed on the frame in the transversal direction for pushing the cathode blank.

12 Claims, 12 Drawing Sheets

(56) References Cited

U.S. PATENT DOCUMENTS

| | | | | |
|---|---|---|---|---|
| 4,806,213 | A * | 2/1989 | Leiponen et al. | 205/76 |
| 5,149,410 | A | 9/1992 | Robinson et al. | |
| 6,079,093 | A * | 6/2000 | Segerstrom | 29/426.5 |
| 7,306,706 | B2 * | 12/2007 | Robinson et al. | 204/279 |
| 7,964,080 | B2 * | 6/2011 | Mornholm | 205/76 |
| 8,607,837 | B2 * | 12/2013 | Ruddell et al. | 156/759 |

FOREIGN PATENT DOCUMENTS

| | | | |
|---|---|---|---|
| CN | 101153404 | A | 4/2008 |
| CN | 101717973 | A | 6/2010 |
| CN | 201587998 | U | 9/2010 |

* cited by examiner

APPARATUS FOR STRIPPING METAL SHEETS FROM CATHODE BLANK

CROSS-REFERENCE TO RELATED APPLICATION

This application is a Section 371 National Stage Application of International Application No. PCT/CN2010/080200, filed Dec. 23, 2010, which is incorporated by reference in its entirety and published as WO 2011/076137 on Jun. 30, 2011, not in English.

FIELD

The present disclosure generally relates to the field of a non-ferrous metallurgical apparatus, more particularly, to an apparatus for stripping metal sheets from a cathode blank.

BACKGROUND

In the copper electrolytic refining process, in order to obtain electrodeposited metals deposited on a cathode blank due to copper electrolytic smelting, electrodeposited metal sheets are needed to be separated from the cathode blank.

In a conventional apparatus for stripping a metal sheet from a cathode blank, an inserting knife is inserted into a gap generated between the cathode blank and the deposited metal sheet, and then the inserting knife is horizontally pulled by two horizontally moving devices which are symmetrically disposed, so as to allow the inserting knife to drive the deposited metal sheet to move in an opposite direction simultaneously, until the deposited metal sheet is entirely separated from a lower end of the cathode blank. After flattened by a pair of rollers, the deposited metal sheet falls onto a chain. In this process, because the deposited metal sheet separated from a stainless steel plate slides downwardly along a sliding slot, the onsite noise is very large; and the impact on the chain and the destruction of the chain due to the deposited metal sheet are very large, so that a part of the copper sheet which is contacted with the chain may be deformed and the life of the chain may be shorten.

SUMMARY

Embodiments of the present disclosure seek to solve at least one of the problems existing in the prior art to at least some extent. Accordingly, An apparatus for stripping metal sheets from a cathode blank is provided, which may reduce the operation noise. Moreover, the quality of the stripped deposited metal sheets is reliable.

According to embodiments of the present disclosure, there is provided an apparatus for stripping metal sheets from a cathode blank. The apparatus comprises: a frame; a stripping assembly disposed on the frame for stripping deposited metal sheets from two surfaces of the cathode blank; and a receiving mechanism. The stripping assembly comprises: at least one clipping mechanism disposed on an upper part of the frame, spaced apart from each other in a longitudinal direction, and configured to clip a conductive member on an upper end of the cathode blank; first and second stripping mechanisms disposed on two sides of the frame in a transversal direction respectively, disposed below the at least one clipping mechanism in a vertical direction respectively, and configured to strip the deposited metal sheets from two surfaces of the cathode blank; a bottom positioning mechanism disposed on the frame and configured to position a lower end of the cathode blank; and first and second loosening mechanisms disposed on two sides of the frame in the transversal direction respectively, the first loosening mechanism being disposed between the first stripping mechanism and the bottom positioning mechanism in the vertical direction, the second loosening mechanism being disposed between the second stripping mechanism and the bottom positioning mechanism in the vertical direction, and each of the first and second loosening mechanisms comprising a push rod which is movably disposed on the frame in the transversal direction and configured to push the cathode blank. The receiving mechanism comprises at least one receiving platform. The receiving platform is disposed on the frame, movable between an upper limit position and a lower limit position in the vertical direction and configured to receive the deposited metal sheets stripped from the cathode blank.

With the apparatus for stripping metal sheets from the cathode blank according to embodiments of the present disclosure, by disposing the receiving mechanism below the stripping assembly for receiving the stripped deposited metal sheets, the noise caused by falling of the deposited metal sheets in the conventional apparatus for stripping metal sheets from a cathode blank may be avoided, the destruction of the downstream devices caused by the impact of the deposited metal sheets may also be avoided, and the deposited metal sheets may not be scratched during the falling thereof.

In an embodiment, the apparatus for stripping metal sheets from the cathode blank further comprises: first and second forcedly stripping mechanisms disposed on the frame, located at two sides of the cathode blank in the longitudinal direction respectively, spaced apart from each other in the longitudinal direction, and configured to forcedly separate deposited metal sheets connected to two surfaces of the lower end of the cathode blank respectively from the cathode blank.

Each of first and second forcedly stripping mechanisms comprises: a forcedly stripping support mounted onto the frame; a feeding arm defining a first end pivotably connected to the forcedly stripping support; a swinging arm pivotably mounted onto the feeding arm; a hacking knife mounted onto a first end of the swinging arm; a transversal movement driver mounted onto the forcedly stripping support and connected to the feeding arm to drive the feeding arm to swing in the transversal direction; and a hacking driver mounted onto the feeding arm and connected to a second end of the swinging arm.

Alternatively, each of the transversal movement driver and the hacking driver is a pneumatic cylinder or a hydraulic cylinder.

In an embodiment, the apparatus for stripping metal sheets from the cathode blank further comprises: a pressing and turnover mechanism which is turnablely disposed on the frame, and receives the stripped deposited metal sheets from the receiving platform and clips and turns over the deposited metal sheets when the receiving platform is moved to the lower limit position. The pressing and turnover mechanism comprises: a pressing and turnover support mounted onto the frame; a pressing head rotatablely mounted onto the pressing and turnover support; a pressing driver mounted onto the pressing and turnover support and configured to drive the pressing head to rotate; a turnover support rotatablely mounted onto the pressing and turnover support; and a turnover driver mounted onto the pressing and turnover support and configured to drive the turnover support to rotate.

In another embodiment, the receiving mechanism further comprises: a receiving track mounted onto the frame, along which the receiving platform is moved upwardly or downwardly; and a receiving driver defining a first end in the vertical direction connected to the receiving platform and a second end in the vertical direction connected to the frame for driving the receiving platform to move upwardly or downwardly.

In an embodiment, each clipping mechanism comprises: a clip support fixed on the frame; a synchronous gear unit disposed on the clip support; and a clip driver for driving the first gear and the second gear to rotate in the opposite directions. The synchronous gear unit comprises: first and second gears which are rotated synchronously in opposite directions; and first and second clipping plates, first ends of the first and second clipping plates being pivotably disposed on the first and second gears respectively, and second ends of the first and second clipping plates clip or release the conductive member with the rotation of the first and second gears in the opposite directions; and Further, each clipping mechanism further comprises: first and second clipping blocks disposed on the second ends of the first and second clipping plates respectively.

In an embodiment, each of the first and second stripping mechanisms comprises: a stripping support mounted onto the frame; an inserting knife pivotably mounted onto the stripping support for stripping the deposited metal sheets; and an inserting knife driver mounted onto the frame for driving the inserting knife to pivot.

With the apparatus for stripping metal sheets from the cathode blank according to an embodiment of the present disclosure, by employing a metal sheet stripping way in which the inserting knife is directly rotated, the structure of the apparatus is simple and reliable, the working time may be saved, and the working efficiency may be increased.

In an embodiment, each of the first and second loosening mechanisms further comprises: a loosening support fixed on the frame; a loosening driver disposed on the loosening support and connected to the push rod for driving the push rod to move in the transversal direction; and a plurality of protrusions disposed on an inner side of the push rod and spaced apart from each other for pushing the cathode blank.

In an embodiment, the bottom positioning mechanism comprises: a positioning support fixed on the frame; a positioning member mounted onto the positioning support for positioning the lower end of the cathode blank; and a positioning driver disposed on the positioning support and connected to the positioning member for driving the positioning member to position the lower end of the cathode blank.

Alternatively, there are two bottom positioning mechanisms oppositely disposed on two sides of the frame in the transversal direction respectively, in which the positioning drivers in the two bottom positioning mechanisms simultaneously drive the positioning members in the two bottom positioning mechanisms respectively so as to allow the positioning members to move inwardly to clip the lower end of the cathode blank or to move outwardly to release the lower end of the cathode blank.

Each bottom positioning mechanism further comprises: a plurality of bosses disposed on an inner side of the positioning member for clipping the lower end of the cathode blank.

With the apparatus for stripping metal sheets from the cathode blank according to an embodiment of the present disclosure, by using the receiving mechanism and the pressing and turnover mechanism, the deposited metal sheets stripped from the cathode blank may be steadily transported to a horizontal conveying mechanism, thus reducing the operation noise, avoiding scratches of the deposited metal sheets during falling thereof, improving the quality of the deposited metal sheets, avoiding the impact on the apparatus, and prolonging the life of the entire apparatus. In addition, by using the first and second forcedly stripping mechanisms, the process of stripping the deposited metal sheets may be more reliable.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

DETAILED DESCRIPTION

Figure 1:
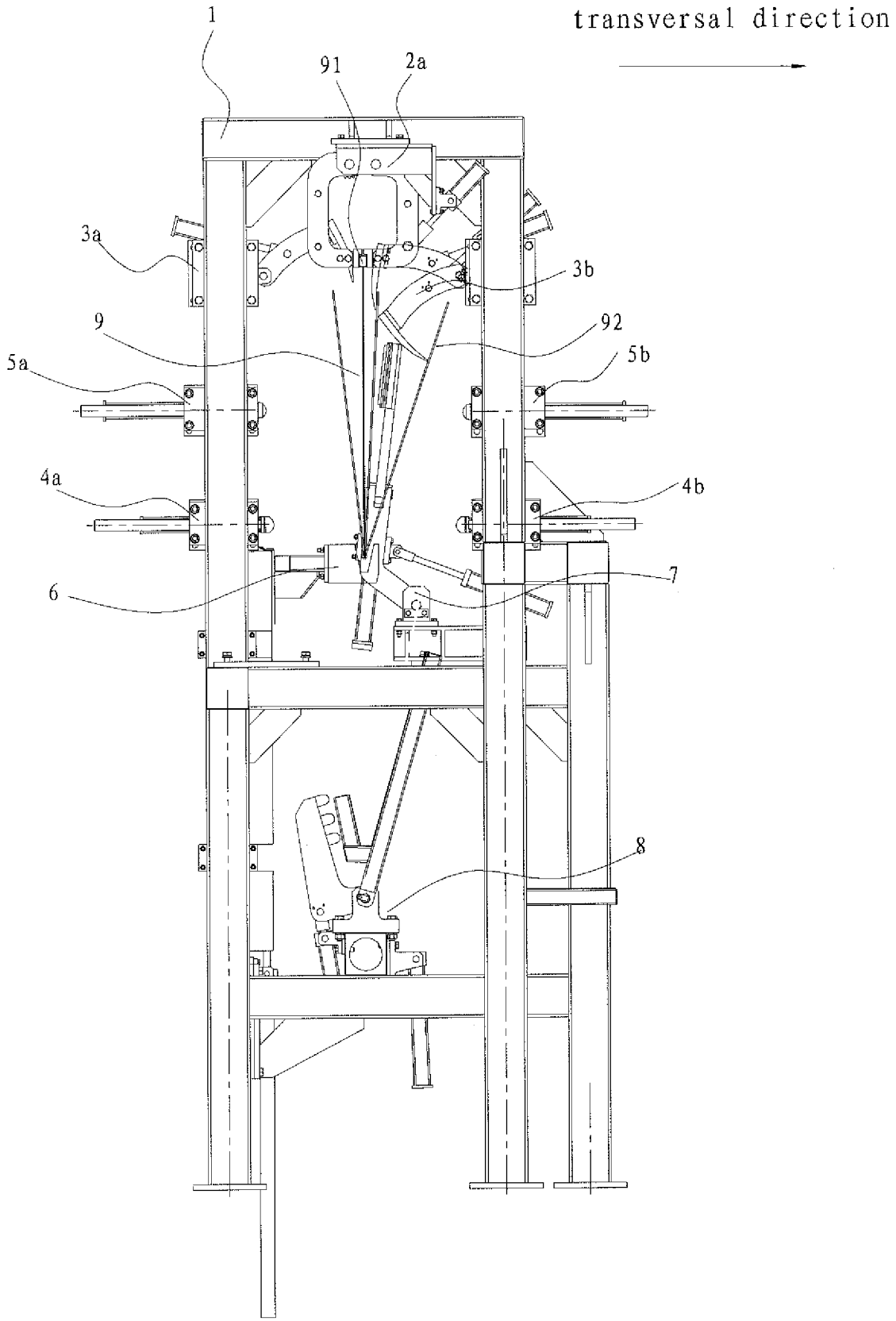
FIG. 1 is a structural view of an apparatus for stripping metal sheets from a cathode blank seen from an angle according to an embodiment of the present disclosure.

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

In the specification, unless specified or limited otherwise, relative terms such as "central", "longitudinal", "transversal", "front", "rear", "right", "left", "inner", "outer", "lower", "upper", "horizontal", "vertical", "above", "below", "up", "top", "bottom" as well as derivative thereof (e.g., "horizontally", "downwardly", "upwardly", etc.) should be construed to refer to the orientation as then described or as shown in the drawings under discussion. These relative terms are for convenience of description and do not require that the present disclosure be constructed or operated in a particular orientation.

Unless specified or limited otherwise, the terms "mounted," "connected," and "coupled" and variations thereof are used broadly and encompass both direct and indirect mountings, connections, supports, and couplings. Further, "connected" and "coupled" are not restricted to physical or mechanical connections or couplings.

The apparatus for stripping metal sheets from the cathode blank according to embodiments of the present disclosure will be described below with reference to FIG. 1. The apparatus for stripping metal sheets from the cathode blank according to embodiments of the present disclosure may be used for stripping deposited metal sheets 92 such as copper sheets, which are electrodeposited on two surfaces of the cathode blank 9. In the following, it will be explanatorily described by using a stainless steel cathode blank as the cathode blank 9, in which the stainless steel cathode blank is constituted by a stainless steel plate and a conductive member 91 fixed onto an upper end of the stainless steel plate. In addition, it should be noted that the apparatus for stripping metal sheets from the cathode blank according to embodiments of the present disclosure is not limited to using the stainless steel cathode blank, but may use cathode blanks of other materials. Therefore, the above stainless steel cathode blank is for explanatory purpose, but shall not be construed to limit the scope of the present disclosure.

As shown in FIGS. 1-12, the apparatus for stripping metal sheets from the cathode blank according to embodiments of the present disclosure comprises: a frame 1, a stripping assembly and a receiving mechanism 6. The stripping assembly is disposed on the frame 1 for stripping deposited metal sheets 92 from two surfaces of the cathode blank 9. The stripping assembly comprises at least one clipping mechanism, first and second stripping mechanisms 3*a*, 3*b*, a bottom positioning mechanism, and first and second loosening mechanisms 5*a*, 5*b*.

Figure 12:
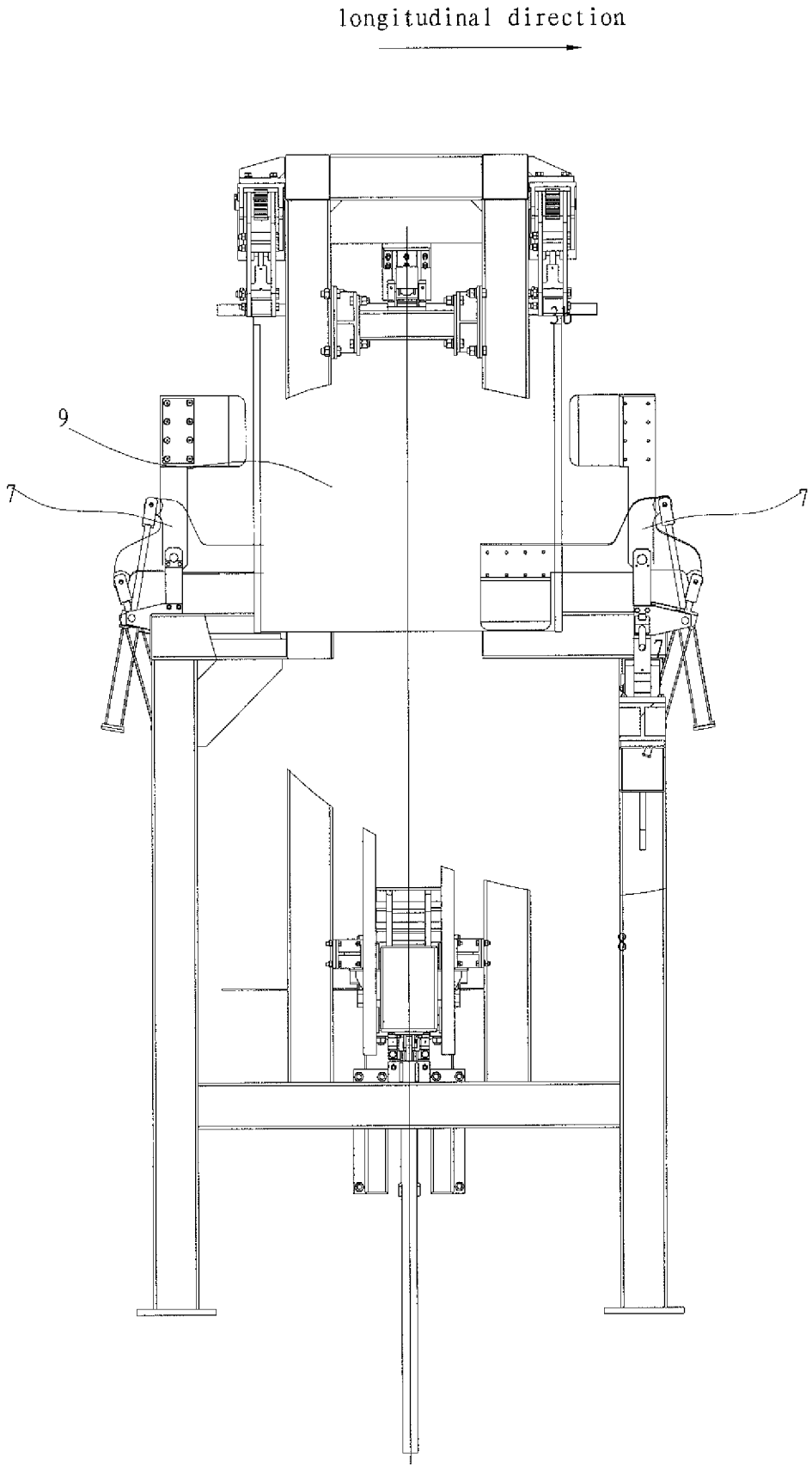
FIG. 12 is a structural view of the apparatus for stripping metal sheets from the cathode blank shown in FIG. 1 seen from another angle, in which the operation of the first and second forcedly stripping mechanisms is shown.

As shown in FIG. 1 and FIG. 12, in an example of the present disclosure, two clipping mechanisms, i.e., first and second clipping mechanisms 2*a*, 2*b*, are provided. The first and second clipping mechanisms 2*a*, 2*b* are disposed on an upper part of the frame 1, spaced apart from each other in a longitudinal direction (the left and right direction in FIG. 12), and configured to clip two ends of a conductive member 91 in the longitudinal direction on an upper end of the cathode blank 9 respectively. Because the cathode blank 9 has a certain length in the longitudinal direction, clipping two ends of the conductive member 91 in the longitudinal direction by the first and second clipping mechanisms 2*a*, 2*b* may allow the upper end of the cathode blank 9 to be clipped stably, thus avoiding deteriorating quality of the stripped deposited metal sheets due to the fact that the deposited metal sheets 92 are stripped during moving of the cathode blank 9. Certainly, the present disclosure is not limited to this. For example, one clipping mechanism may be provided and clips a center of the conductive member 91 on the upper end of the cathode blank 9. Alternatively, three or more clipping mechanisms may be provided, so as to clip the conductive member 91 on the upper end of the cathode blank 9 better.

The first and second stripping mechanisms 3*a*, 3*b* are disposed at two sides of the frame 1 in a transversal direction respectively (as shown in FIG. 1, the first stripping mechanism 3*a* is disposed at a left side of the frame 1, and the second stripping mechanism 3*b* is disposed at a right side of the frame 1), disposed below the first and second clipping mechanisms 2*a*, 2*b* in the vertical direction respectively, and configured to strip the deposited metal sheets 92 from two surfaces of the cathode blank 9. The bottom positioning mechanism is disposed on the frame 1 and configured to position a lower end of the cathode blank 9.

The first and second loosening mechanisms 5*a*, 5*b* are disposed at two sides of the frame 1 in the transversal direction respectively, the first loosening mechanism 5*a* is disposed between the first stripping mechanism 3*a* and the bottom positioning mechanism in the vertical direction, and the second loosening mechanism 5*b* is disposed between the second stripping mechanism 2*b* and the bottom positioning mechanism in the vertical direction. Each of the first and second loosening mechanisms 5*a*, 5*b* comprises a push rod 51 which is movably disposed on the frame 1 in the transversal direction and configured to push the cathode blank 9, such that the cathode blank 9 is deformed by pushing of the push rod 51 so as to separate upper ends of the deposited metal sheets 92 on two surfaces of the cathode blank 9 from the cathode blank 9 respectively, and then the first and second stripping mechanisms 3*a*, 3*b* are inserted between the cathode blank 9 and the deposited metal sheet 92 on the left surface of the cathode blank 9 and between the cathode blank 9 and the deposited metal sheet 92 on the right surface of the cathode blank 9 respectively to peel off the deposited metal sheets 92.

The receiving mechanism 6 comprises at least one receiving platform 61. The receiving platform 61 is disposed on the frame 1, movable between an upper limit position and a lower limit position in the vertical direction, and configured to receive the deposited metal sheets 92 stripped from the cathode blank 9.

With the apparatus for stripping metal sheets from the cathode blank according to embodiments of the present disclosure, by disposing a receiving mechanism below the stripping assembly for receiving the stripped deposited metal sheets, the noise caused by falling of the deposited metal sheets in a conventional apparatus for stripping metal sheets from a cathode blank may be avoided, the destruction of the downstream devices caused by the impact of the deposited metal sheets may also be avoided, and the deposited metal sheets may not be scratched during the falling.

Figure 2:
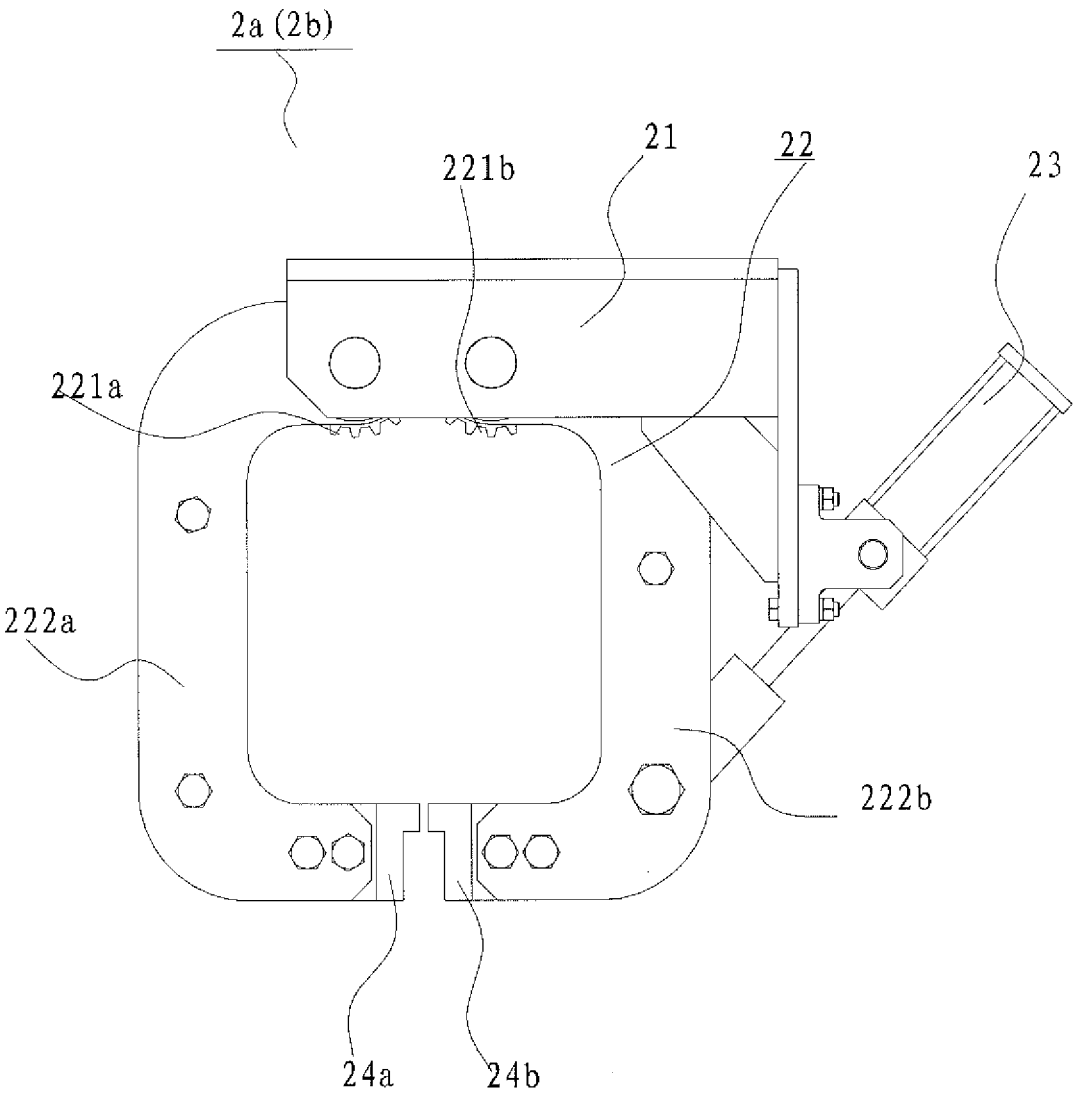
FIG. 2 is a schematic view of first or second clipping mechanism of the apparatus for stripping metal sheets from the cathode blank shown in FIG. 1.

In an embodiment, as shown in FIG. 2, each of the first and second clipping mechanisms 2*a*, 2*b* comprises a clip support 21, a synchronous gear unit 22 and a clip driver 23. The clip support 21 is fixed on the frame 1. The synchronous gear unit 22 is disposed on the clip support 21 and comprises first and second gears 221*a*, 221*b* as well as first and second clipping plates 222*a*, 222*b*. The first and second gears 221*a*, 221*b* may be rotated synchronously in opposite directions. First ends of the first and second clipping plates 222*a*, 222*b* are pivotably disposed on the first and second gears 221*a*, 221*b* respectively, and second ends of the first and second clipping plates 222*a*, 222*b* clip or release the conductive member 91 with the rotation of the first and second gears 221*a*, 221*b* in the opposite directions. The clip driver 23 is configured to drive the first gear 221*a* and the second gear 221*b* to rotate in the opposite directions.

In an example of the present disclosure, each of the first and second clipping mechanisms 2*a*, 2*b* further comprises first and second clipping blocks 24*a*, 24*b*. As shown in FIG. 2, the first and second clipping blocks 24*a*, 24*b* are disposed on the second ends of the first and second clipping plates 222*a*, 222*b* respectively so as to position the conductive member 91 between the first clipping block 24*a* and second clipping block 24*b*. Therefore, the clip drivers 23 of the first and second clipping mechanisms 2*a*, 2*b* simultaneously drive the first and second gears 221*a*, 221*b* to rotate synchronously in opposite directions respectively, so as to clip or release two ends of the conductive member 91 in the longitudinal direction.

Figure 3:
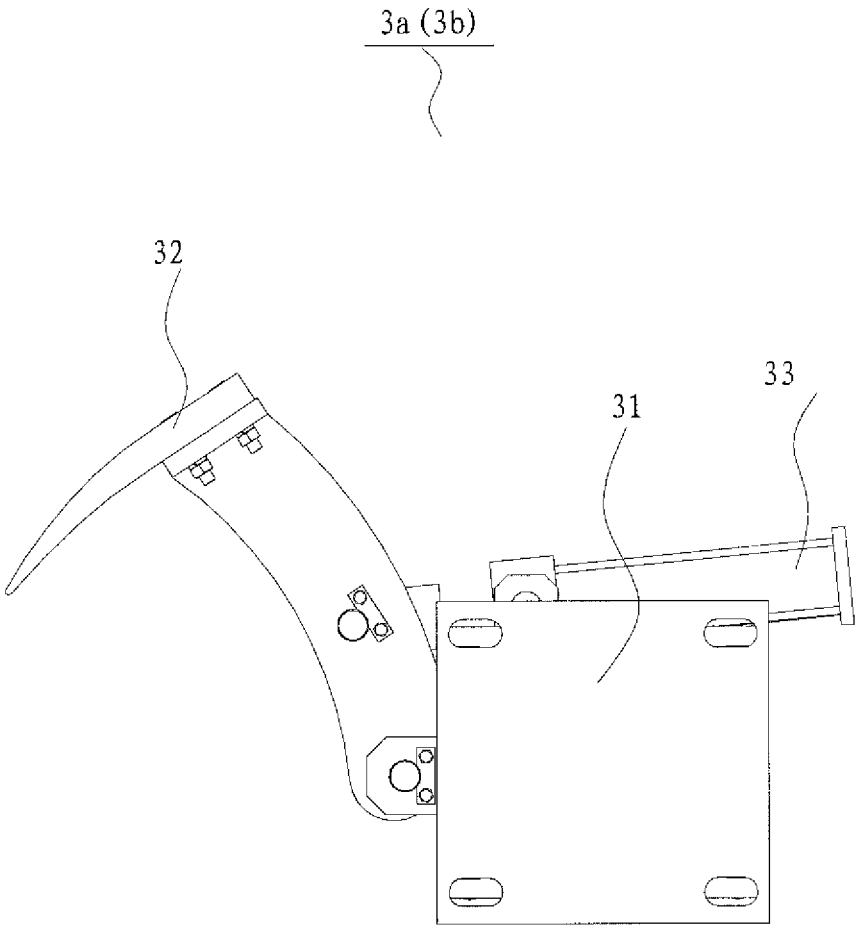
FIG. 3 is a schematic view of first or second stripping mechanism of the apparatus for stripping metal sheets from the cathode blank shown in FIG. 1.

In an embodiment of the present disclosure, as shown in FIG. 3, each of the first and second stripping mechanisms 3*a*, 3*b* comprises a stripping support 31, an inserting knife 32 and an inserting knife driver 33. The stripping support 31 is mounted onto the frame 1. The inserting knife 32 is pivotably mounted onto the stripping support for stripping the deposited metal sheets 92. The inserting knife driver 33 is mounted onto the frame 1 for driving the inserting knife 32 to pivot. Alternatively, the inserting knife 32 has an arc shape. When the inserting knife drivers 33 of the first and second stripping mechanisms 3*a*, 3*b* drive the inserting knives 32 to rotate respectively, the inserting knives 32 of the first and second stripping mechanisms 3*a*, 3*b* strip the deposited metal sheets 92 on two surfaces of the cathode blank 9 from the top down respectively. With the apparatus for stripping metal sheets from the cathode blank according to the embodiment of the present disclosure, by employing a metal sheet stripping way in which the inserting knife is directly rotated, the structure of the apparatus is simple and reliable, the working time may be saved, and the working efficiency may be improved.

Figure 4:
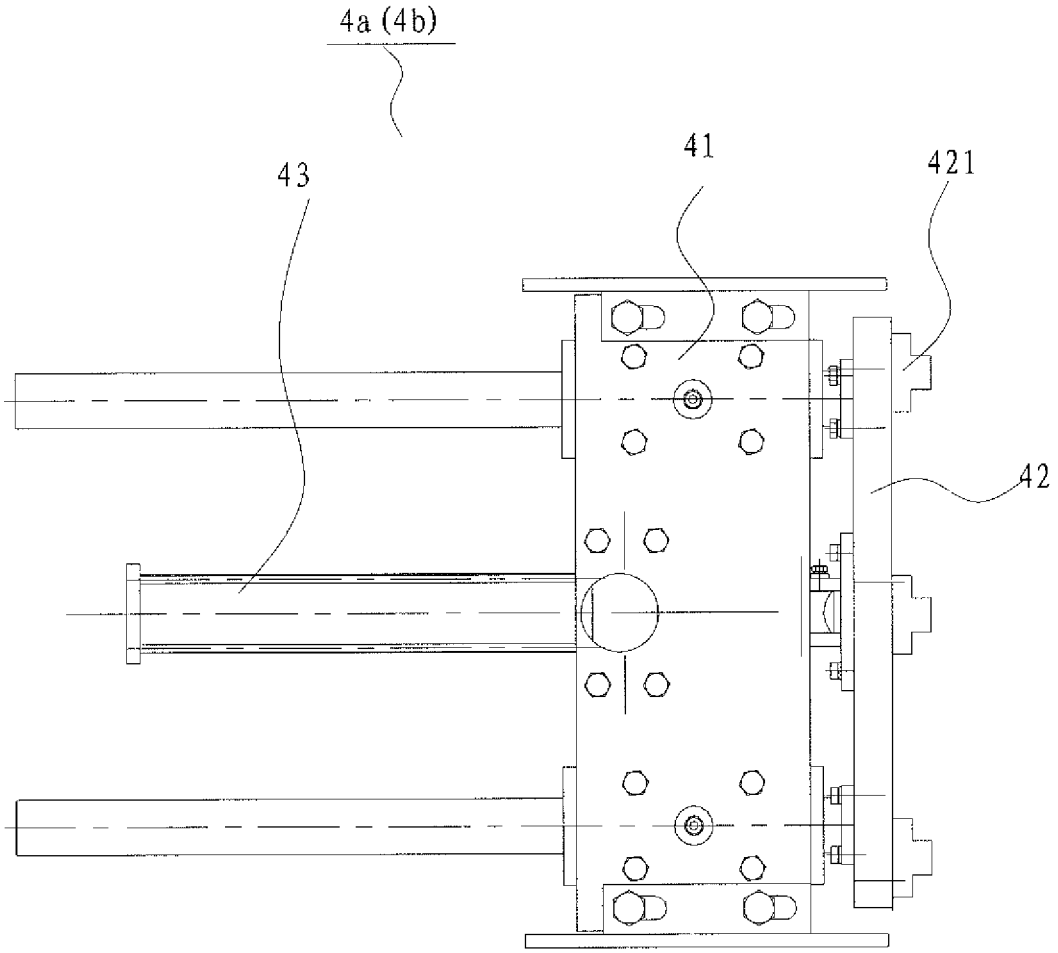
FIG. 4 is a schematic view of first or second bottom positioning mechanism of the apparatus for stripping metal sheets from the cathode blank shown in FIG. 1.

In an embodiment, the bottom positioning mechanism comprises a positioning support 41, a positioning member 42 and a positioning driver 43. The positioning support 41 is fixed on the frame 1. The positioning member 42 is mounted onto the positioning support 41 for positioning the lower end of the cathode blank 9. The positioning driver 43 is disposed on the positioning support 41 and connected to the positioning member 42 for driving the positioning member 42 to position the lower end of the cathode blank 9. In an embodiment, two bottom positioning mechanisms are oppositely disposed at two sides of the frame 1 in the transversal direction respectively. That is, as shown in FIG. 4, the bottom positioning mechanism comprises a first bottom positioning mechanism 4*a* disposed at the left side of the frame 1 and a second bottom positioning mechanism 4*b* disposed at the right side of the frame 1, and the positioning members 42 of the first and second bottom positioning mechanism 4*a*, 4*b* are opposite to each other. Therefore, when the apparatus for stripping metal sheets from the cathode blank according to embodiments of the present disclosure operates, the positioning drivers 43 in the first and second bottom positioning mechanism 4*a*, 4*b* simultaneously drive the positioning members 42 in the first and second bottom positioning mechanism 4*a*, 4*b* respectively, so as to allow the positioning members 42 to move inwardly to clip the lower end of the cathode blank 9 or to move outwardly to release the lower end of the cathode blank 9.

In an example of the present disclosure, each of the first and second bottom positioning mechanism 4*a*, 4*b* further comprises a plurality of bosses 421. The bosses 421 are disposed on an inner side of the positioning member 42 for clipping the lower end of the cathode blank 9. That is, the bosses 421 are disposed on inner sides of the positioning members 42 in the first and second bottom positioning mechanism 4*a*, 4*b* respectively, so as to clip the lower end of the cathode blank 9 better, as shown in FIG. 4.

Figure 5:
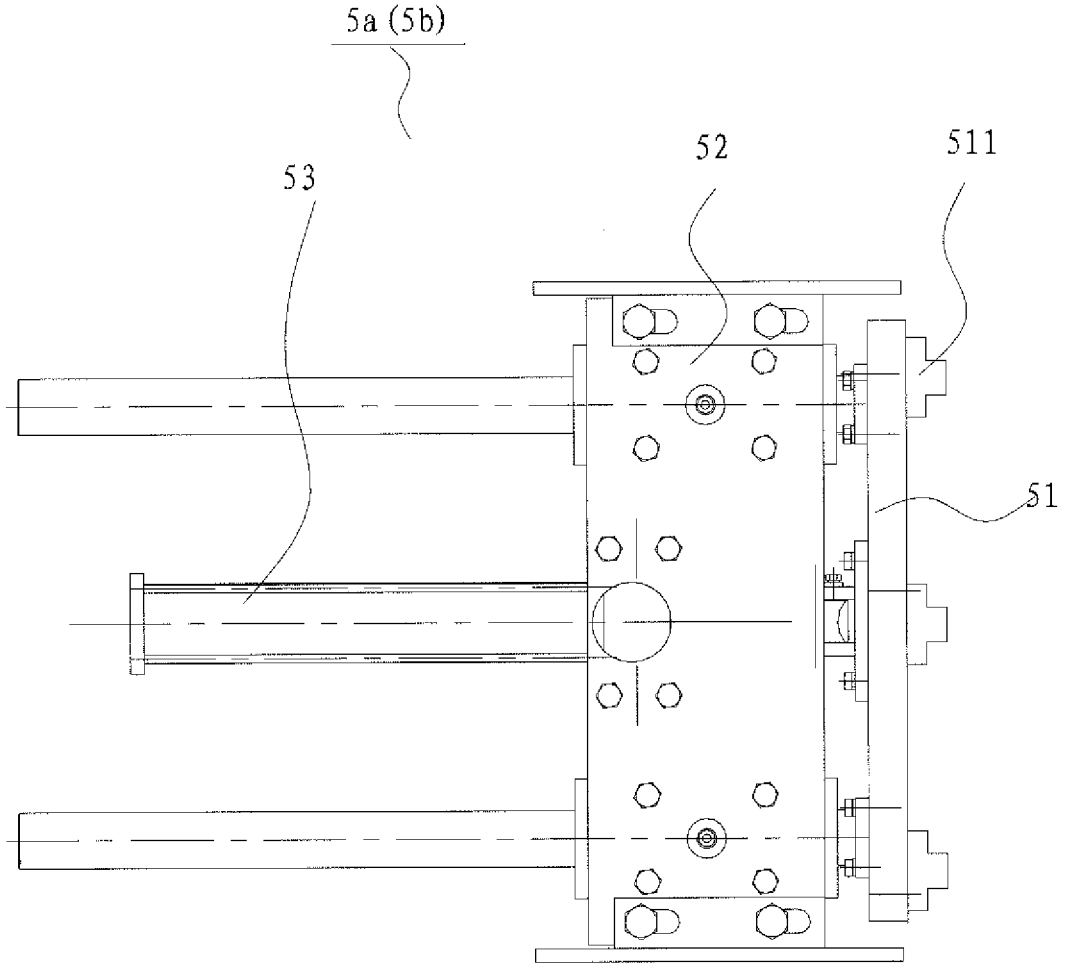
FIG. 5 is a schematic view of first or second loosening mechanism of the apparatus for stripping metal sheets from the cathode blank shown in FIG. 1.

In an embodiment, as shown in FIG. 5, each of the first and second loosening mechanisms 5*a*, 5*b* further comprises a loosening support 52, a loosening driver 53 and a plurality of protrusions 511. The loosening support 52 is fixed on the frame 1. The loosening driver 53 is disposed on the loosening support 52 and connected to the push rod 51 for driving the push rod 51 to move in the transversal direction. The protrusions 511 are disposed on an inner side of the push rod 51 and spaced apart from each other for pushing the cathode blank 9.

Figure 9:
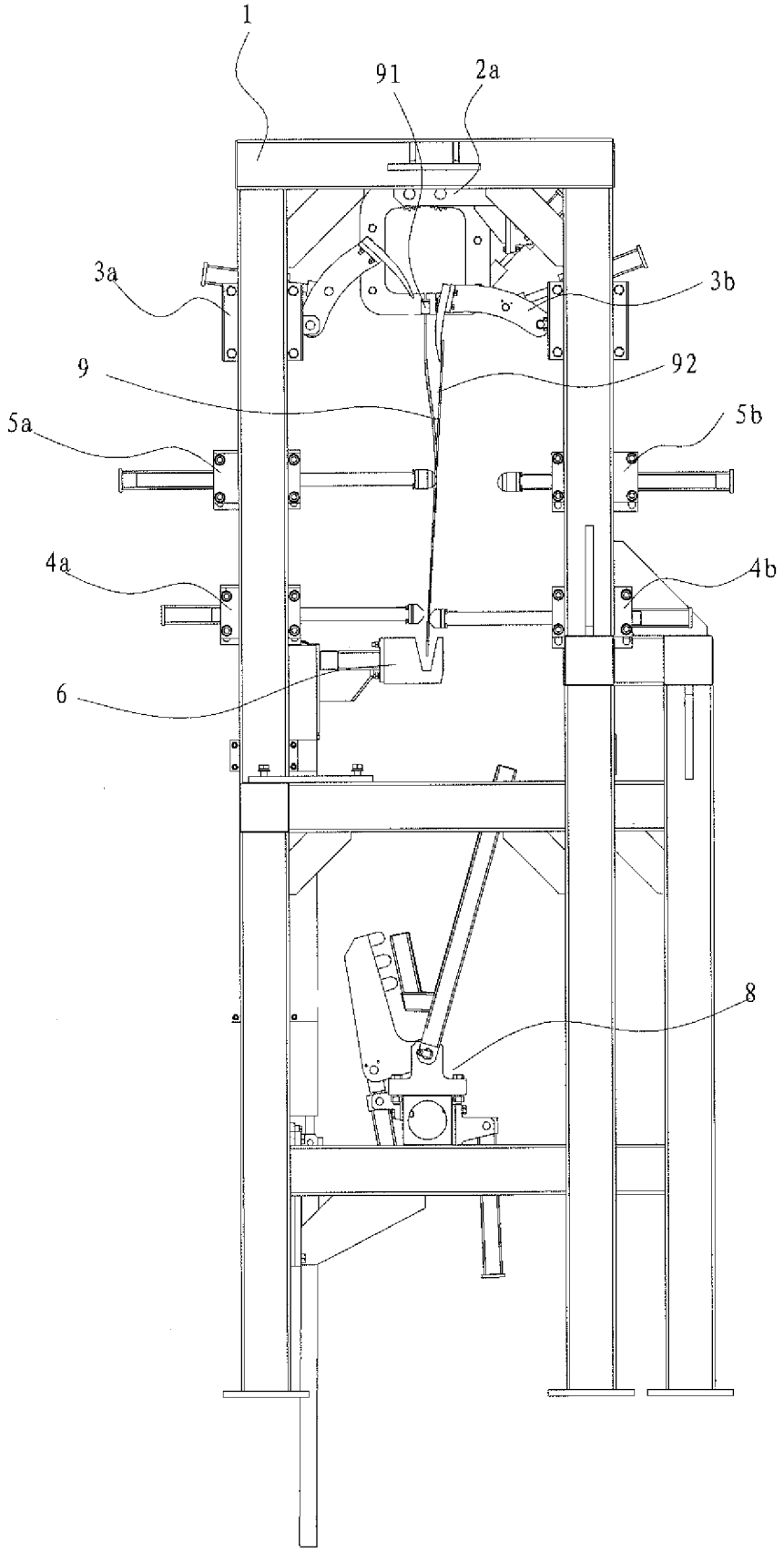
FIG. 9 is a schematic working view of the apparatus for stripping metal sheets from the cathode blank shown in FIG. 1, in which an upper end of the deposited metal sheet on the right surface of the cathode blank is separated from the cathode blank by the first loosening mechanism.
Figure 10:
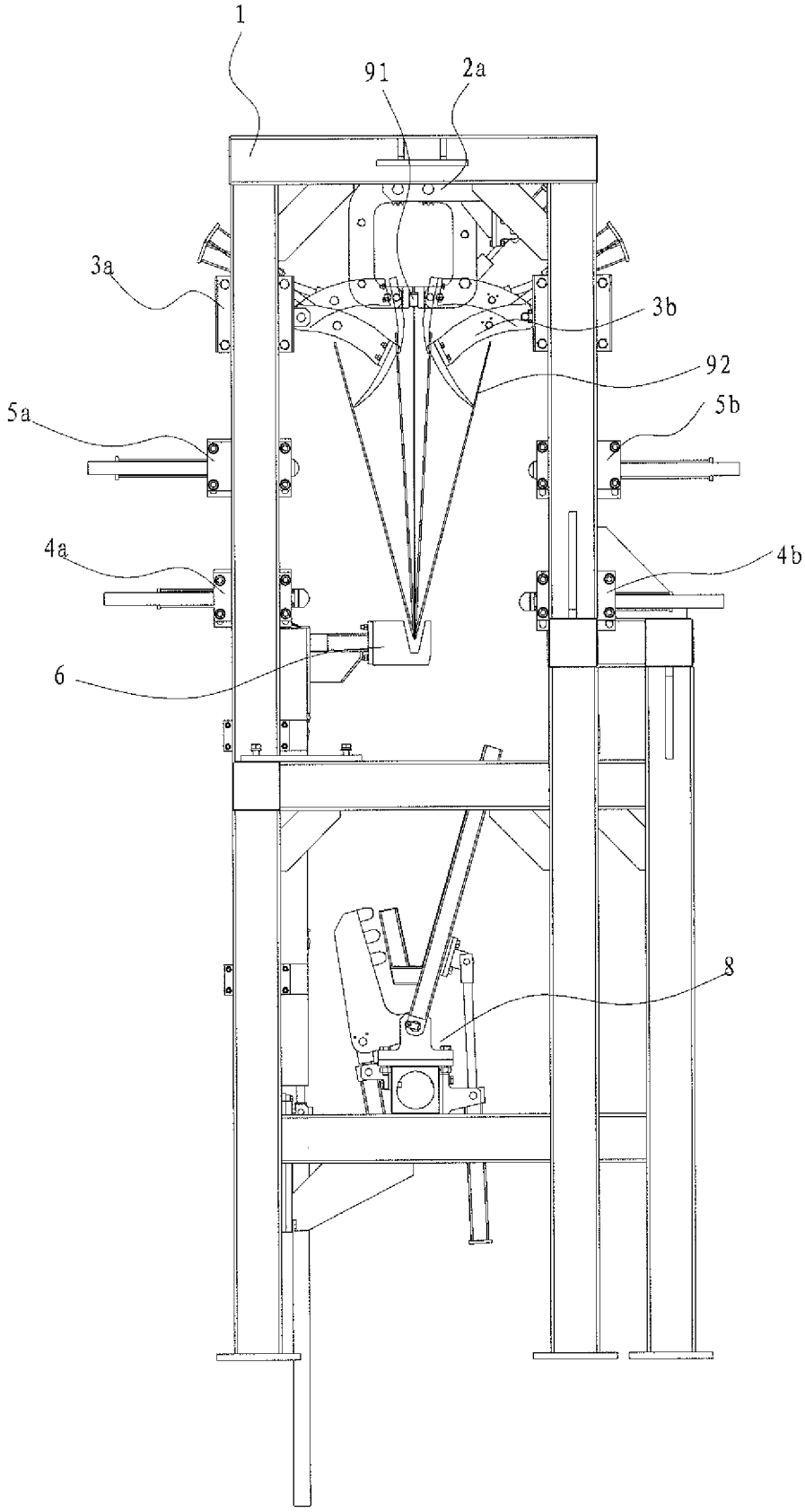
FIG. 10 is a schematic working view of the apparatus for stripping metal sheets from the cathode blank shown in FIG. 1, in which the deposited metal sheets on two surfaces of the cathode blank are stripped and fall onto the receiving platform.

Particularly, two ends of the conductive member 91 in the longitudinal direction on the upper end of the cathode blank 9 are positioned by the first and second clipping mechanisms 2*a*, 2*b* respectively, the lower end of the cathode blank 9 is clipped by the first and second bottom positioning mechanism 4*a*, 4*b*, and the push rod 51 of one loosening mechanism such as the first loosening mechanism 5*a* is extended out towards the cathode blank 9 in the transversal direction, until the protrusions 511 push against the cathode blank 9 to deform the cathode blank 9. Therefore, the upper end of the deposited metal sheet 92 on the right surface of the cathode blank 9 is separated from the cathode blank 9, and the inserting knife 32 of the second stripping mechanism 3*b* is inserted between the cathode blank 9 and the deposited metal sheet 92 on the right surface of the cathode blank 9, as shown in FIG. 9. Then, the push rod 51 of the first loosening mechanism 5*a* is retracted back to its original position. At this time, the push rod 51 of the second loosening mechanism 5*b* is extended out towards the cathode blank 9 in the transversal direction, until the protrusions 511 push against the cathode blank 9 to deform the cathode blank 9. Therefore, the upper end of the deposited metal sheet 92 on the left surface of the cathode blank 9 is separated from the cathode blank 9, and the inserting knife 32 of the first stripping mechanism 3*a* is inserted between the cathode blank 9 and the deposited metal sheet 92 on the left surface of the cathode blank 9, as shown in FIG. 10. Then, the push rod 51 of the second loosening mechanism 5*b* is retracted back to its original position. At this time, the inserting knives 32 of the first and second stripping mechanisms 3*a*, 3*b* simultaneously rotate, such that the deposited metal sheets 92 on two surfaces of the cathode blank 9 are stripped from the cathode blank 9, the bottoms of the deposited metal sheets 92 on two surfaces of the cathode blank 9 are connected to each other, and the deposited metal sheets 92 fall onto the receiving platform 61 of the receiving mechanism 6 below the deposited metal sheets 92.

Certainly, it would be appreciated by those skilled in the art that the operation sequence of the first and second loosening mechanisms 5*a*, 5*b* and the first and second stripping mechanisms 3*a*, 3*b* is not limited to the above sequence. In an embodiment, firstly, the second loosening mechanism 5*b* may separate the upper end of the deposited metal sheet 92 on the left surface of the cathode blank 9 from the cathode blank 9 and the inserting knife 32 of the first stripping mechanism 3*a* is inserted between the cathode blank 9 and the deposited metal sheet 92 on the left surface of the cathode blank 9, and then the first loosening mechanism 5*a* separates the upper end of the deposited metal sheet 92 on the right surface of the cathode blank 9 from the cathode blank 9 and the inserting knife 32 of the second stripping mechanism 3*b* is inserted between the cathode blank 9 and the deposited metal sheet 92 on the right surface of the cathode blank 9. In another embodiment, the first and second loosening mechanisms 5*a*, 5*b* may simultaneously operate. At this time, it should be noted that the first and second loosening mechanisms 5*a*, 5*b* should be not located in the same horizontal plane in the vertical direction.

If the above operations can not separate the deposited metal sheets 92 from the cathode blank 9, in some embodiments, the apparatus for stripping metal sheets from the cathode blank further comprises first and second forcedly stripping mechanisms 7*a*, 7*b*. The first and second forcedly stripping mechanisms 7*a*, 7*b* are disposed on the frame 1, located at two sides of the cathode blank 9 in the longitudinal direction respectively, spaced apart from each other in the longitudinal direction, and configured to forcedly separate deposited metal sheets 92 connected to two surfaces of the lower end of the cathode blank 9 from the cathode blank 9 respectively, as shown in FIG. 12.

Figure 7:
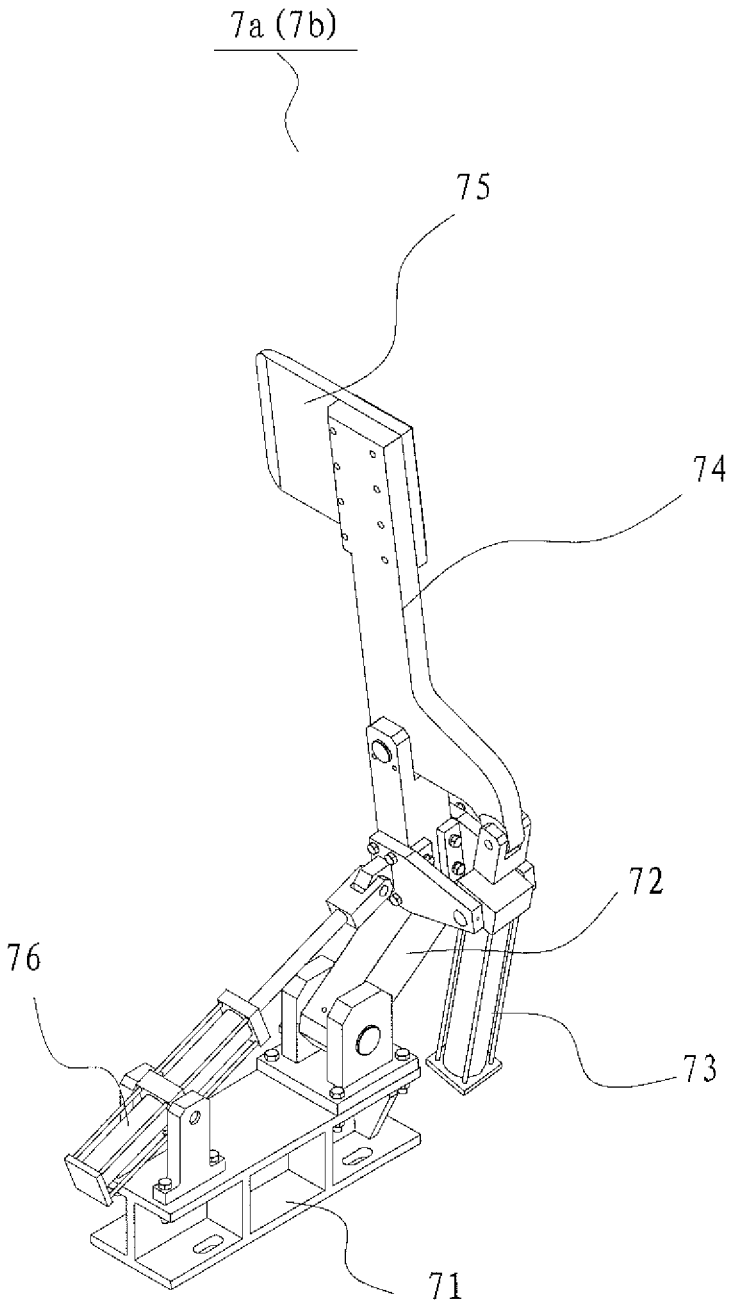
FIG. 7 is a perspective view of first or second forcedly stripping mechanism of the apparatus for stripping metal sheets from the cathode blank shown in FIG. 1.

In an example of the present disclosure, as shown in FIG. 7, each of first and second forcedly stripping mechanisms 7*a*, 7*b* comprises: a forcedly stripping support 71, a feeding arm 72, a swinging arm 74, a hacking knife 75, a transversal movement driver 76 and a hacking driver 73. The forcedly stripping support 71 is mounted onto the frame 1. The feeding arm 72 has a first end pivotably connected to the forcedly stripping support 71. The swinging arm 74 is pivotably mounted onto the feeding arm 72. The hacking knife 75 is mounted onto a first end of the swinging arm 74. A plane in which the hacking knife 75 is located is parallel to that in which the cathode blank 9 is located, so as to forcedly separate deposited metal sheets 92 connected to two surfaces of the lower end of the cathode blank 9 from the cathode blank 9 respectively.

The transversal movement driver 76 is mounted onto the forcedly stripping support 71 and connected to the feeding arm 72 to drive the feeding arm 72 to swing in the transversal direction. The hacking driver 73 is mounted onto the feeding arm 72 and connected to a second end of the swinging arm 74. The feeding arm 72 may be driven by the transversal movement driver 76 to move in the transversal direction so as to determine a transversal position of the hacking knife 75, and then the hacking driver 73 drives the swinging arm 74 along with the hacking knife 75 to rotate in the longitudinal direction so as to forcedly separate deposited metal sheets 92 connected to two surfaces of the lower end of the cathode blank 9 from the cathode blank 9 respectively. Alternatively, each of the transversal movement driver 76 and the hacking driver 73 is a pneumatic cylinder or a hydraulic cylinder.

It should be noted that the drivers mentioned in the specification (comprising all the drivers mentioned) are not limited to pneumatic cylinders or hydraulic cylinders. It would be appreciated by those skilled in the art that the drivers used in the apparatus for stripping metal sheets from the cathode blank according to embodiments of the present disclosure may be other types of driving devices such as a motor.

It should be noted that the first and second forcedly stripping mechanisms 7*a*, 7*b* are located at two sides of the cathode blank 9 in the longitudinal direction respectively. In this way, when the deposited metal sheets 92 is not completely separated from the cathode blank 9 by the first and second stripping mechanisms 3*a*, 3*b*, the hacking knives 75 of the first and second forcedly stripping mechanisms 7*a*, 7*b* are fed between the cathode blank 9 and the deposited metal sheet 92 on the left surface of the cathode blank 9 and between the cathode blank 9 and the deposited metal sheet 92 on the right surface of the cathode blank 9 in the transversal direction by the transversal movement drivers 76 of the first and second forcedly stripping mechanisms 7*a*, 7*b* respectively, and then driven by the hacking drivers 73 of the first and second forcedly stripping mechanisms 7*a*, 7*b* to rotate so as to hack between the cathode blank 9 and the deposited metal sheet 92 on the left surface of the cathode blank 9 and between the cathode blank 9 and the deposited metal sheet 92 on the right surface of the cathode blank 9 respectively, such that the deposited metal sheets 92 are separated from the cathode blank 9 and fall onto the receiving platform 61.

Figure 6:
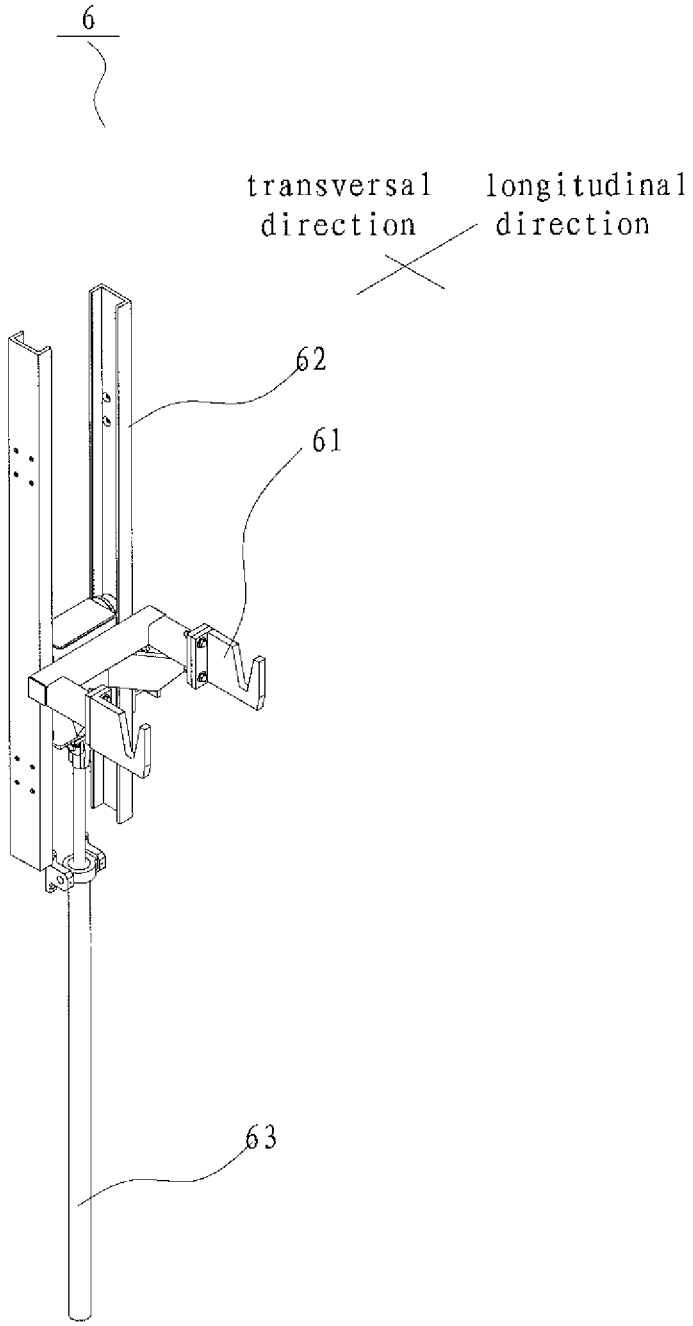
FIG. 6 is a perspective view of the receiving mechanism of the apparatus for stripping metal sheets from the cathode blank shown in FIG. 1.

In some embodiments, the receiving mechanism 6 further comprises a receiving track 62 and a receiving driver 63, as shown in FIG. 6. The receiving track 62 is mounted onto the frame 1, and at least one receiving platform 61 is disposed on the receiving track 62 and moved upwardly or downwardly along the receiving track 62. The receiving driver 63 has a first end in the vertical direction connected to the receiving platform 61 and a second end in the vertical direction connected to the frame 1 for driving the receiving platform 61 to move upwardly or downwardly. In an embodiment, two receiving platforms 61 are spaced apart from each other in the longitudinal direction, such that the deposited metal sheets 92 after being stripped and falling, are received by the two receiving platforms 61, and moved between the upper limit position and the lower limit position in the vertical direction.

Alternatively, a "V"-shaped opening is fanned at a position of the top of each receiving platform 61 corresponding to the cathode blank 9. Because the bottoms of the deposited metal sheets 92 on two surfaces of the stripped cathode blank 9 are connected to each other to form a substantially "V" shape, when the deposited metal sheets 92 fall into the "V"-shaped opening, the deposited metal sheets 92 may be stably received.

In some embodiment, as shown in FIG. 1, the apparatus for stripping metal sheets from the cathode blank further comprises a pressing and turnover mechanism 8. The pressing and turnover mechanism 8 is turnablely disposed on the frame 1, and configured to receive the stripped deposited metal sheets 92 from the receiving platform 61 and to clip and turn over the deposited metal sheets 92 when the receiving platform 61 is moved to the lower limit position. Alternatively, the two receiving platforms 61 are disposed at two sides of the pressing and turnover mechanism 8 in the longitudinal direction, such that the pressing and turnover mechanism 8 may easily receive the stripped deposited metal sheets 92 from the receiving platform 61 and clip the deposited metal sheets 92.

Figure 8:
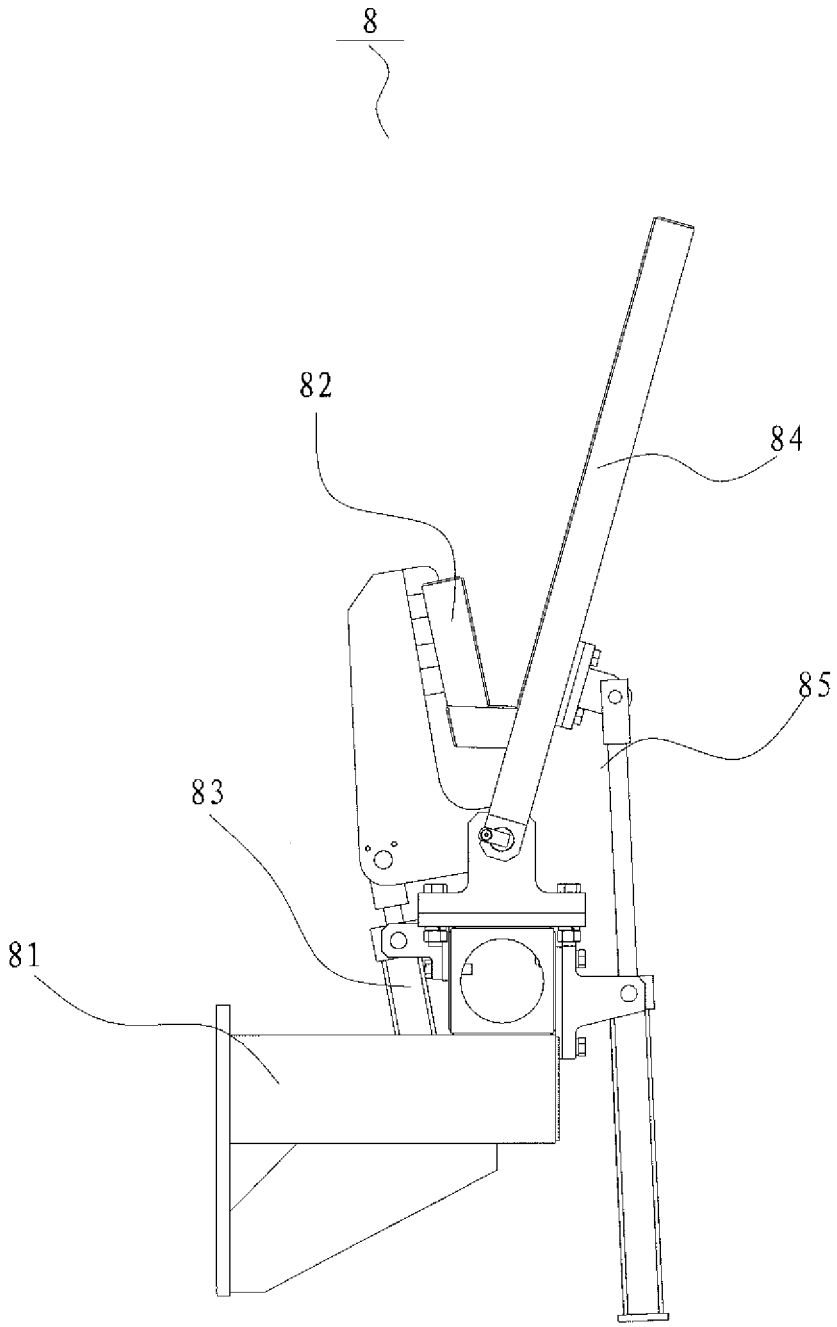
FIG. 8 is a schematic view of first or second pressing and turnover mechanism of the apparatus for stripping metal sheets from the cathode blank shown in FIG. 1.

The pressing and turnover mechanism 8 comprises a pressing and turnover support 81, a pressing head 82, a pressing driver 83, a turnover support 84 and a turnover driver 85. As shown in FIG. 8, the pressing and turnover support 81 is mounted onto the frame 1, the pressing head 82 is rotatablely mounted onto the pressing and turnover support 81, and the pressing driver 83 is mounted onto the pressing and turnover support 81 and configured to drive the pressing head 82 to rotate. The turnover support 84 is rotatablely mounted onto the pressing and turnover support 81. The turnover driver 85 is mounted onto the pressing and turnover support 81 and configured to drive the turnover support 84 to rotate. Particularly, after two deposited metal sheets 92, the bottoms of which are connected to each other, are placed between the pressing head 82 and the turnover support 84, the pressing driver 83 drives the pressing head 82 to rotate so as to flatten the two deposited metal sheets 92 onto the turnover support 84, and then the turnover driver 85 drives the turnover support 84 to rotate to a horizontal position, such that the two deposited metal sheets 92 may be steadily transported to a subsequent horizontal conveying mechanism such as a chain (not shown).

With the apparatus for stripping metal sheets from the cathode blank according to an embodiment of the present disclosure, by employing the receiving mechanism and the pressing and turnover mechanism, the deposited metal sheets stripped from the cathode blank may be steadily transported to the horizontal conveying mechanism, thus reducing the operation noise, avoiding scratching the deposited metal sheets during falling, improving the quality of the deposited metal sheets, avoiding impacts on the devices, and prolonging the life of the entire apparatus. In addition, by employing first and second forcedly stripping mechanisms, the process of stripping the deposited metal sheets may be more reliable.

The operation of the apparatus for stripping metal sheets from the cathode blank according to embodiments of the present disclosure will be described below with reference to FIGS. 8-12. Similarly, the stainless steel cathode blank is used as the cathode blank 9.

Firstly, the cathode blank 9 on which the deposited metal sheets are to be stripped, is conveyed to a working position, two ends of the conductive member 91 in the longitudinal direction on the upper end of the cathode blank 9 are positioned by the first and second clipping mechanisms 2*a*, 2*b* respectively, the lower end of the cathode blank 9 is clipped by the first and second bottom positioning mechanism 4*a*, 4*b*, and the push rod 51 of the first loosening mechanism 5*a* of the first and second loosening mechanisms 5*a*, 5*b* is extended out towards the cathode blank 9 in the transversal direction, until the protrusions 511 push against the cathode blank 9 to deform the cathode blank 9. Therefore, the upper end of the deposited metal sheet 92 on the right surface of the cathode blank 9 is separated from the cathode blank 9, and the inserting knife 32 of the second stripping mechanism 3*b* is inserted between the cathode blank 9 and the deposited metal sheet 92 on the right surface of the cathode blank 9, as shown in FIG. 9. Then, the push rod 51 of the first loosening mechanism 5*a* is retracted back to its original position.

At this time, the push rod 51 of the second loosening mechanism 5*b* is extended out towards the cathode blank 9 in the transversal direction, until the protrusions 511 push against the cathode blank 9 to deform the cathode blank 9. Therefore, the upper end of the deposited metal sheet 92 on the left surface of the cathode blank 9 is separated from the cathode blank 9, and the inserting knife 32 of the first stripping mechanism 3*a* is inserted between the cathode blank 9 and the deposited metal sheet 92 on the left surface of the cathode blank 9, as shown in FIG. 10. Then, the push rod 51 of the second loosening mechanism 5*b* is retracted back to its original position.

Then, the inserting knives 32 of the first and second stripping mechanisms 3*a*, 3*b* are driven by the inserting knife drivers 33 of the first and second stripping mechanisms 3*a*, 3*b* to rotate in a transversal plane respectively, as shown in FIG. 10, such that the deposited metal sheets 92 on two surfaces of the cathode blank 9 are stripped from the cathode blank 9, the bottoms of the deposited metal sheets 92 on two surfaces of the cathode blank 9 may be connected to each other, and the deposited metal sheets 92 fall into the V-shaped opening of the receiving platform 61 of the receiving mechanism 6 located below the deposited metal sheets 92.

In this process, if the deposited metal sheets 92 is not completely separated from the cathode blank 9 by the first and second stripping mechanisms 3*a*, 3*b*, the hacking knives 75 of the first and second forcedly stripping mechanisms 7*a*, 7*b* may be fed between the cathode blank 9 and the deposited metal sheet 92 on the left surface of the cathode blank 9 and between the cathode blank 9 and the deposited metal sheet 92 on the right surface of the cathode blank 9 in the transversal direction by the transversal movement drivers 76 of the first and second forcedly stripping mechanisms 7*a*, 7*b* respectively, and then driven by the hacking drivers 73 of the first and second forcedly stripping mechanisms 7*a*, 7*b* to rotate so as to hack between the cathode blank 9 and the deposited metal sheet 92 on the left surface of the cathode blank 9 and between the cathode blank 9 and the deposited metal sheet 92 on the right surface of the cathode blank 9 respectively, such that the deposited metal sheets 92 are completely separated from the cathode blank 9 and fall onto the receiving platform 61.

Figure 11:
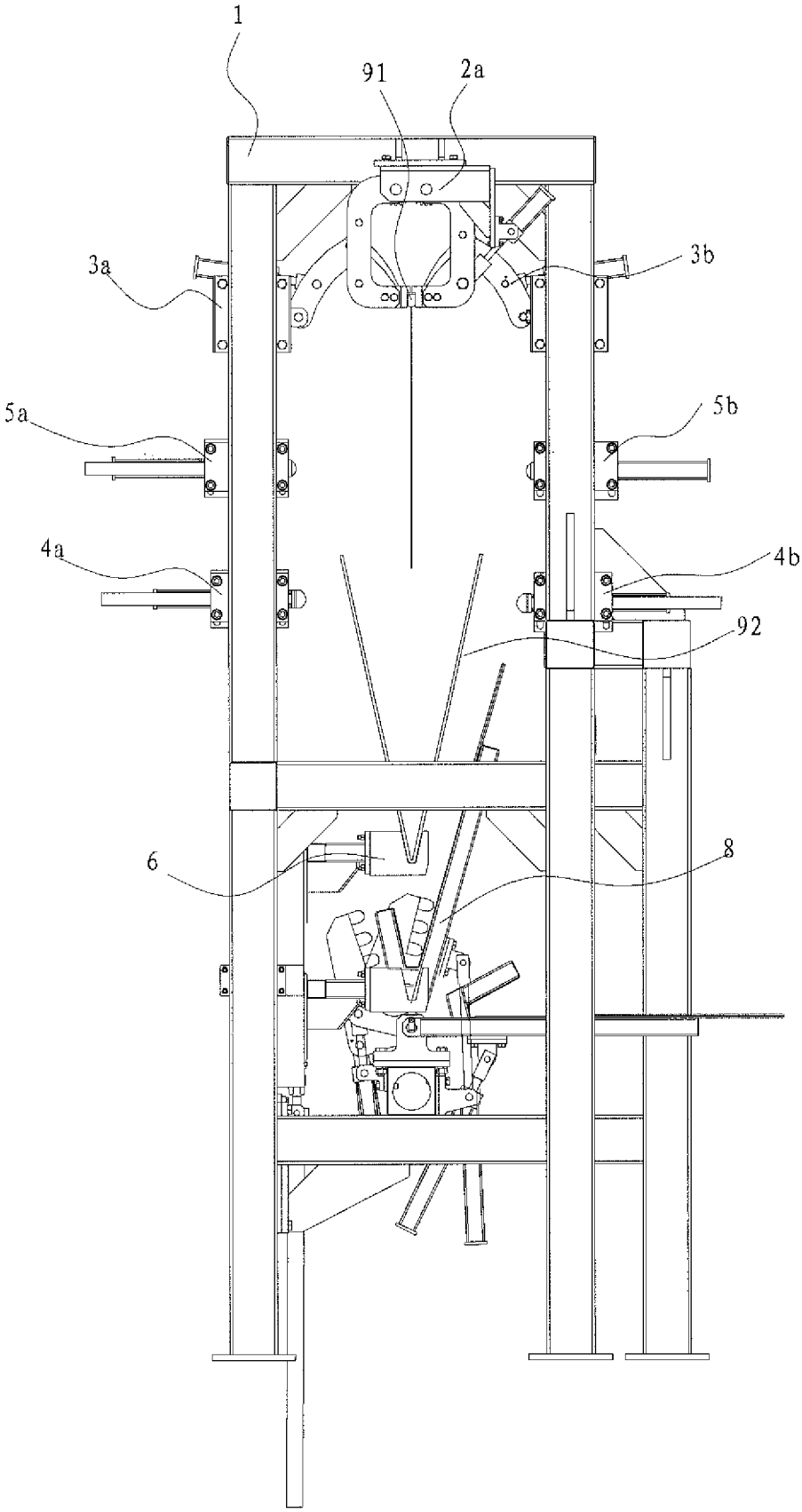
FIG. 11 is a schematic working view of the apparatus for stripping metal sheets from the cathode blank shown in FIG. 1, in which the receiving platform is moved downwardly.

As shown in FIG. 11, the deposited metal sheets 92 after being stripped and falling, are received by the two receiving platforms 61 and moved downwardly to the lower limit position in the vertical direction, and then received by the pressing and turnover support 81. At this time, the two deposited metal sheets 92, the bottoms of which are connected to each other, are placed between the pressing head 82 and the turnover support 84, the pressing driver 83 drives the pressing head 82 to rotate so as to flatten the two deposited metal sheets 92 onto the turnover support 84, and then the turnover driver 85 drives the turnover support 84 to rotate to the horizontal position, such that the two deposited metal sheets 92 may be steadily transported to a subsequent horizontal conveying mechanism.

Reference throughout this specification to "an embodiment," "some embodiments," "an embodiment", "another example," "an example," "a specific examples," or "some examples," means that a particular feature, structure, material, or characteristic described in connection with the embodiment or example is included in at least an embodiment or example of the present disclosure. Thus, the appearances of the phrases such as "in some embodiments," "in an embodiment", "in an embodiment", "in another example, "in an example," "in a specific examples," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments can not be construed to limit the present disclosure, and changes, alternatives, and modifications can be made in the embodiments without departing from spirit, principles and scope of the present disclosure.

What is claimed is:

1. An apparatus for stripping metal sheets from a cathode blank, comprising:

a frame;

a stripping assembly disposed on the frame for stripping deposited metal sheets from two surfaces of the cathode blank and comprising:

first and second clipping mechanisms disposed on an upper part of the frame, spaced apart from each other in a longitudinal direction, and configured to clip a conductive member on an upper end of the cathode blank;

first and second stripping mechanisms disposed on two sides of the frame in a transversal direction respectively, disposed below the first and second clipping mechanisms in a vertical direction respectively, and configured to strip the deposited metal sheets from two surfaces of the cathode blank, and each of the first and second stripping mechanisms comprising a stripping support mounted onto the frame, an inserting knife pivotably mounted onto the stripping support, and an inserting knife driver mounted onto the frame for driving the inserting knife to pivot such that the deposited metal sheets are stripped from the cathode blank only by rotating the inserting knife;

a bottom positioning mechanism disposed on the frame and configured to position a lower end of the cathode blank; and first and second loosening mechanisms disposed on two sides of the frame in the transversal direction respectively, the first loosening mechanism being disposed between the first stripping mechanism and the bottom positioning mechanism in the vertical direction, the second loosening mechanism being disposed between the second stripping mechanism and the bottom positioning mechanism in the vertical direction, and each of the first and second loosening mechanisms comprising a push rod which is movably disposed on the frame in the transversal direction and configured to push the cathode blank;

a receiving mechanism comprising at least one receiving platform, a receiving track mounted onto the frame, along which the receiving platform is moved upwardly or downwardly, and a receiving driver defining a first end in the vertical direction connected to the receiving platform and a second end in the vertical direction connected to the frame for driving the receiving platform, the receiving platform being moved between an upper limit position and a lower limit position in the vertical direction and configured to receive the deposited metal sheets stripped from the cathode blank; and a pressing and turnover mechanism which is turnably disposed on the frame, and receives the stripped deposited metal sheets from the receiving platform and clips and turns over the deposited metal sheets when the receiving platform is moved to the lower limit position.

2. The apparatus according to claim 1, further comprising:

first and second forcedly stripping mechanisms disposed on the frame, located at two sides of the cathode blank in the longitudinal direction respectively, spaced apart from each other in the longitudinal direction, and configured to forcedly separate deposited metal sheets connected to two surfaces of the lower end of the cathode blank respectively from the cathode blank.

3. The apparatus according to claim 2, wherein each of first and second forcedly stripping mechanisms comprises:

a forcedly stripping support mounted onto the frame;

a feeding arm defining a first end pivotably connected to the forcedly stripping support;

a swinging arm pivotably mounted onto the feeding arm;

a hacking knife mounted onto a first end of the swinging arm;

a transversal movement driver mounted onto the forcedly stripping support and connected to the feeding arm to drive the feeding arm to swing in the transversal direction; and a hacking driver mounted onto the feeding arm and connected to a second end of the swinging arm.

4. The apparatus according to claim 3, wherein each of the transversal movement driver and the hacking driver is a pneumatic cylinder or a hydraulic cylinder.

5. The apparatus according to claim 1, wherein the pressing and turnover mechanism comprises:

a pressing and turnover support mounted onto the frame;

a pressing head rotatablely mounted onto the pressing and turnover support;

a pressing driver mounted onto the pressing and turnover support and configured to drive the pressing head to rotate;

a turnover support rotatablely mounted onto the pressing and turnover support; and a turnover driver mounted onto the pressing and turnover support and configured to drive the turnover support to rotate.

6. The apparatus according to claim 1, wherein each of the first and second clipping mechanisms comprises:

a clip support fixed on the frame;

a synchronous gear unit disposed on the clip support and comprising:

first and second gears which are rotated synchronously in opposite directions; and first and second clipping plates, first ends of the first and second clipping plates being pivotably disposed on the first and second gears respectively, and second ends of the first and second clipping plates clip or release the conductive member with the rotation of the first and second gears in the opposite directions; and a clip driver for driving the first gear and the second gear to rotate in the opposite directions.

7. The apparatus according to claim 6, wherein each of the first and second clipping mechanisms further comprises:

first and second clipping blocks disposed on the second ends of the first and second clipping plates respectively.

8. The apparatus according to claim 1, wherein each of the first and second stripping mechanisms comprises:

a stripping support mounted onto the frame;

an inserting knife pivotably mounted onto the stripping support for stripping the deposited metal sheets; and an inserting knife driver mounted onto the frame for driving the inserting knife to pivot.

9. The apparatus according to claim 1, wherein each of the first and second loosening mechanisms further comprises:

a loosening support fixed on the frame;

a loosening driver disposed on the loosening support and connected to the push rod for driving the push rod to move in the transversal direction; and a plurality of protrusions disposed on an inner side of the push rod and spaced apart from each other for pushing the cathode blank.

10. The apparatus according to claim 1, wherein the bottom positioning mechanism comprises:

a positioning support fixed on the frame;

a positioning member mounted onto the positioning support for positioning the lower end of the cathode blank; and a positioning driver disposed on the positioning support and connected to the positioning member for driving the positioning member to position the lower end of the cathode blank.

11. The apparatus according to claim 10, wherein there are two bottom positioning mechanisms oppositely disposed on two sides of the frame in the transversal direction respectively, in which the positioning drivers in the two bottom positioning mechanisms simultaneously drive the positioning members in the two bottom positioning mechanisms respectively so as to allow the positioning members to move inwardly to clip the lower end of the cathode blank or to move outwardly to release the lower end of the cathode blank.

12. The apparatus according to claim 11, wherein each bottom positioning mechanism further comprises:

a plurality of bosses disposed on an inner side of the positioning member for clipping the lower end of the cathode blank.

* * * * *